US009339069B2

(12) United States Patent
Mazzarolo

(10) Patent No.: US 9,339,069 B2
(45) Date of Patent: May 17, 2016

(54) GLOVE STRUCTURE PROVIDED WITH PROTECTIVE ELEMENTS AND METHOD MANUFACTURING THEREOF

(71) Applicant: ALPINESTARS RESEARCH SRL, Coste di Maser (Treviso) (IT)

(72) Inventor: Giovanni Mazzarolo, Treviso (IT)

(73) Assignee: Alpinestars Research SRL, Coste di Maser (Treviso) (IT)

( * ) Notice: Subject to any disclaimer, the term of this patent is extended or adjusted under 35 U.S.C. 154(b) by 0 days.

(21) Appl. No.: 14/380,506

(22) PCT Filed: Feb. 22, 2013

(86) PCT No.: PCT/IB2013/051442

§ 371 (c)(1),
(2) Date: Aug. 22, 2014

(87) PCT Pub. No.: WO2013/124825

PCT Pub. Date: Aug. 29, 2013

(65) Prior Publication Data

US 2015/0007372 A1 Jan. 8, 2015

(30) Foreign Application Priority Data

Feb. 24, 2012 (IT) ..... TV2012A0028

(51) Int. Cl.
*A41D 19/015* (2006.01)

(52) U.S. Cl.
CPC .... *A41D 19/01505* (2013.01); *A41D 19/01517* (2013.01); *A41D 19/01523* (2013.01)

(58) Field of Classification Search
CPC ..... A41D 19/0024; A41D 19/01523; A41D 19/015; A41D 19/0006; A41D 19/01594; A41D 19/01505; A41D 19/0055; A41D 19/01517; A41D 19/01582; A41D 19/0096; A41D 19/01588; A41D 13/08; A41D 13/081; A41D 13/087; A63B 71/141; A63B 71/14; A63B 71/146; A63B 71/143
USPC ..... 2/16, 159, 160, 161.1, 161.6, 163
See application file for complete search history.

(56) References Cited

U.S. PATENT DOCUMENTS 3,732,575 A * 5/1973 Pakulak ..... 2/16
4,272,849 A 6/1981 Thurston et al.

(Continued)

FOREIGN PATENT DOCUMENTS

DE 10010403 A1 9/2001
JP 2005325456 A 11/2005

OTHER PUBLICATIONS

PCT International Search Report and Written Opinion dated Jul. 5, 2013, from which the instant application is based, 8 pgs.

*Primary Examiner* — Andrew W Collins
(74) *Attorney, Agent, or Firm* — Fredrikson & Byron, P.A.

(57) ABSTRACT

The present invention relates to a glove structure 10 comprising a glove 11 and at least one protective element 12, 14, 16, 16A, 16B, 18, 18A, 18B, 18C suitable for being applied on the dorsal portion 11A of at least one phalanx area of at least one finger portion I, II, III, IV, V of the glove 11. According to the invention said at least one protective element 12, 14, 16, 16A, 16B, 18, 18A, 18B, 18C is made of rigid material and is shaped so as to cover the dorsal portion 11A and the side portions 11C and to leave uncovered the palmar portion 11B of said at least one phalanx area. Said at least one protective element 12, 14, 16, 16A, 16B, 18, 18A, 18B, 18C is adapted to transmit along a path surrounding said at least one phalanx area compression forces acting on said at least one phalanx area. According to the invention, the glove structure 10 comprises at least one patch 21A, 21B, 21C made of microfiber material. The at least one patch 21A, 21B, 21C is fixed on the at least one phalanx area of the at least one finger portion I, II, III, IV, V of the glove 11; said at least one protective element 12, 14, 16, 16A, 16B, 18, 18A, 18B, 18C being applied to the glove 11 so as to be matched with said at least one patch 21A, 21B, 21C. The present invention also relates to a method for manufacturing said glove structure.

22 Claims, 6 Drawing Sheets

(56) References Cited

U.S. PATENT DOCUMENTS

| | | | | |
|---|---|---|---|---|
| 5,442,816 | A * | 8/1995 | Seketa | 2/161.7 |
| 5,511,248 | A | 4/1996 | Widdemer | |
| 5,815,839 | A | 10/1998 | Safford | |
| 5,953,751 | A * | 9/1999 | Kobren | 2/16 |
| 7,467,420 | B2 * | 12/2008 | Ponce et al. | 2/159 |
| 7,856,670 | B1 * | 12/2010 | Hazuga et al. | 2/160 |
| 2003/0066119 | A1 * | 4/2003 | Mazzarolo | 2/161.1 |
| 2005/0114982 | A1 | 6/2005 | Gremmert | |
| 2008/0052799 | A1 * | 3/2008 | Yoo | 2/16 |
| 2009/0281470 | A1 * | 11/2009 | Sandusky et al. | 602/5 |
| 2009/0313742 | A1 * | 12/2009 | Smeltzer | 2/161.2 |
| 2011/0131703 | A1 * | 6/2011 | Mazzarolo | 2/163 |
| 2013/0074242 | A1 * | 3/2013 | Moreland et al. | 2/163 |
| 2014/0304879 | A1 * | 10/2014 | Sgombich Perez | 2/21 |
| 2014/0331377 | A1 * | 11/2014 | Taylor-Lopez | 2/21 |

* cited by examiner

12
X
X

12
IV
G

14
X
X

14
III
G

16A
X
X

16A
II
G
16B
X
X

16B
II
G

18A
X
X

18A
I
G
18B
X
X

18B
I
G
18C
X
X

18C
I
G

16A
Tc
Ts

N
16A
G
II
T
16A
II
G

N
16B
G
II
T
16B
II
G

GLOVE STRUCTURE PROVIDED WITH PROTECTIVE ELEMENTS AND METHOD MANUFACTURING THEREOF

RELATED APPLICATIONS

This application is a 35 U.S.C. 371 national stage filing from International Application No. PCT/IB2013/051442 filed Feb. 22, 2013 and claims priority to Italian Application No. TV2012A000028 filed Feb. 24, 2012, the teachings of which are incorporated herein by reference.

The present invention relates to a glove structure provided with protective elements. The invention also relates to a method for manufacturing said glove structure.

The invention in particular refers, even if in not exclusive way, to a motorcycle glove structure.

It is well known that motorcycling has always been identified as a sport which carries additional risks due to the speed that the riders travel at and the limited protection that clothing can provide if the rider is involved in an accident.

Designers of motorcycle clothing have always to combine two different requirements.

On the one hand, the motorcycle clothing must supply adequate protection to the rider against a severe impact, which normally requires several layers of stiff padding. On the other hand, the motorcycle clothing must be as light and supple as possible to not hinder the rider during his movements.

The hands of the rider are one of the most critical areas to protect, especially the fingers, as these provide very sensitive and delicate inputs to key controls of the motorcycle as the clutch, throttle, brakes, and switches to operate electronic systems.

The aim of the designers of motorcycle clothing has always been to provide suitable protection to the rider's hands, where the use of rigid or semi rigid protectors on the palm side is not feasible.

As a matter of fact, by using rigid or semi-rigid protectors on the palm side the tactile sensation of the controls and the handlebars would be inevitably reduced and this would result in a less precise control of the motorcycle.

Over the years, there have been a number of improvements in motorcycle gloves, such as by adding plastic components or increasing layers of leather on the back side. However, these improvements have achieved only a gradual improvement resistance of the glove against abrasion and impacts. Until now, nothing has been conceived for actually reducing injuries due to the compression of the fingers of the hand, especially to the smallest fingers of the hand, like the ring finger and the little finger.

These fingers are particularly vulnerable to serious injuries if they are crushed in an accident. As a matter of fact, even if the fingers are not abraded so much, the compression of the tip of the fingers can cause serious injuries and even, as an end result, the amputation of the phalanxes. This is a very severe consequence to the riders who are often of a young age and who undergo to a disablement which can affect not only their sportive career, but also their everyday life.

It is known from JP 2005 325456 a glove structure provided on the dorsal portion with C-shaped protective elements. Said protective elements are directly attached to the glove structure by using an adhesive. However, in case of an accident, there is the risk that the protective elements could be separated from the supporting glove structure.

The object of the present invention is to provide a glove structure which solves at least partially the above mentioned problems and drawbacks.

In particular, an aim of the present invention is to provide a glove structure suitable for protecting the fingers against compression shock without hindering the movements of the hand during the normal riding operations.

Moreover, another aim of the present invention is to provide a glove structure suitable for protecting the fingers against compression shocks without reducing the gripping action of the fingers on the motorcycle's controls.

Furthermore, one aim of the present invention is to provide a glove structure provided with protective elements firmly bonded to the support structure.

A further aim of the present invention is to provide a method for manufacturing an improved glove structure according to the invention which is able to reduce the manufacturing time and costs.

Finally, one aim of the present invention is to provide a method for manufacturing an improved glove structure according to the invention which is able to provide a firmly bonding surface for the protective elements to the support structure.

These and other objects and aims are achieved by the structure glove according to claim 1 and by the method according to claim 16.

The advantages and the characteristic features of the invention will emerge more clearly from the following description of a preferred, but not exclusive, embodiment of the glove structure which refers to the accompanying figures in which.

Figure 2:
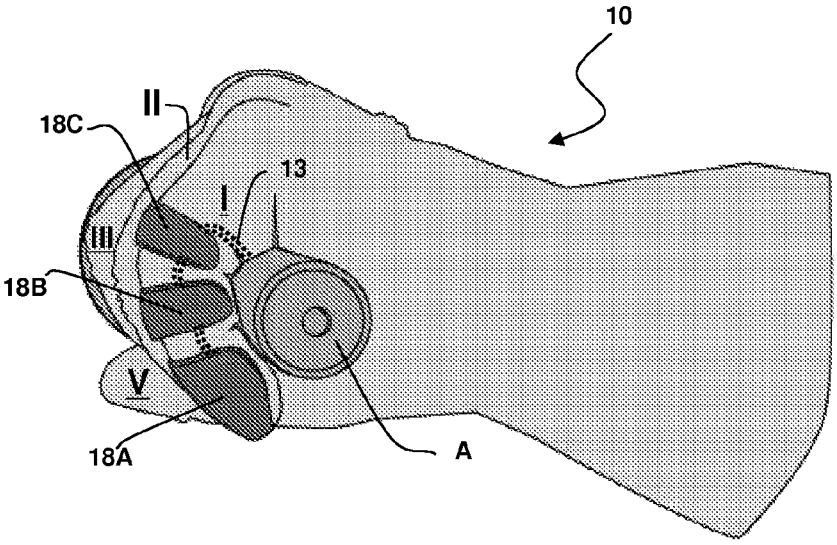
FIG. 2 shows schematically a side view of the glove structure according to the invention, during the gripping action of the handlebar of a motorcycle.
Figure 3:
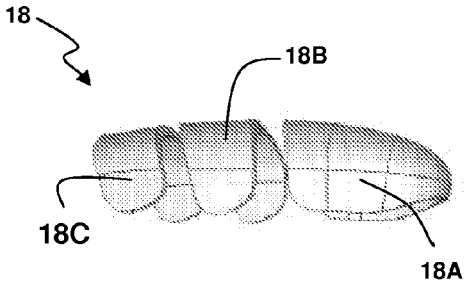
Figure 4:
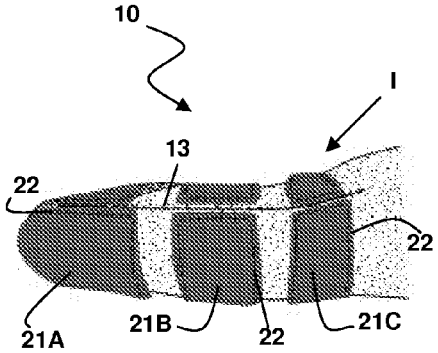
Figure 5:
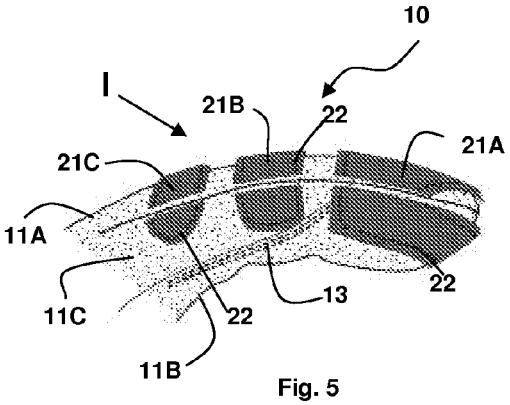
Figure 6:
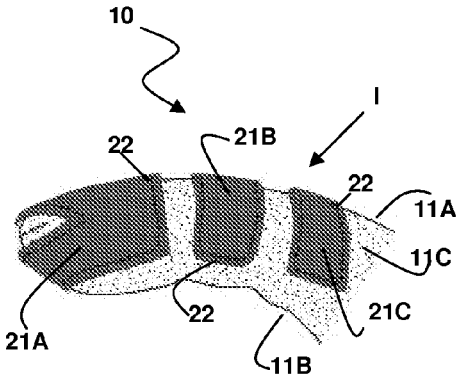
Figure 7:
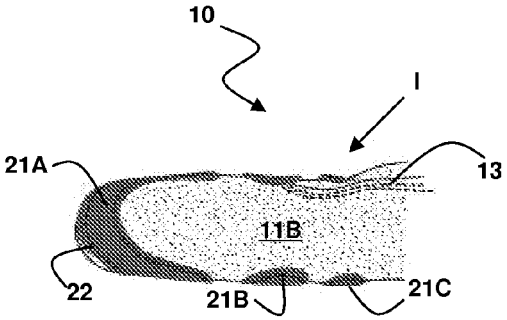
Figure 8:
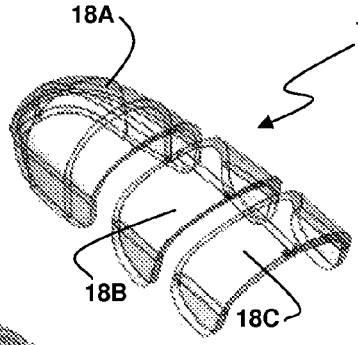
Figure 11:
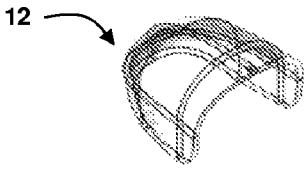
Figure 9:
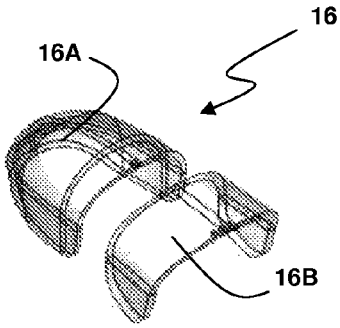
Figure 10:
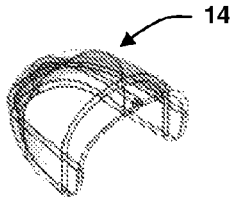
Figure 9A:
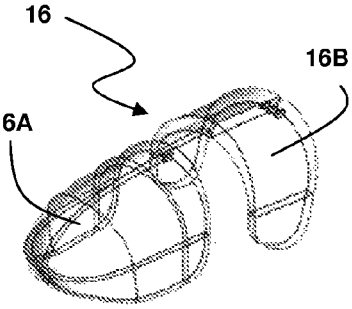
Figure 8A:
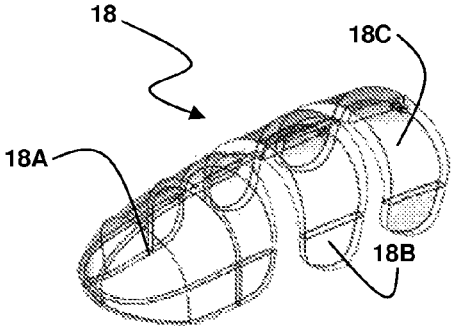
Figure 10A:
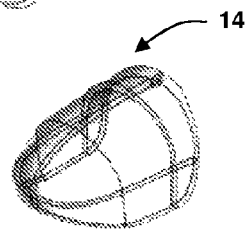
Figure 11A:
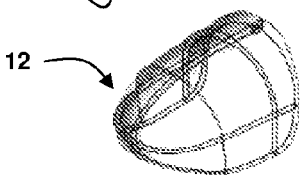
Figure 12A:
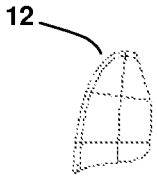
Figure 12:
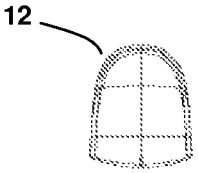
Figure 12B:
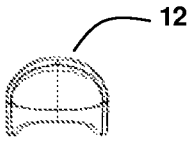
Figure 13A:
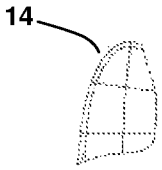
Figure 13:
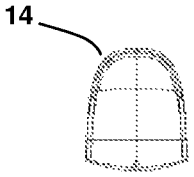
Figure 13B:
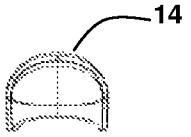
Figure 14A:
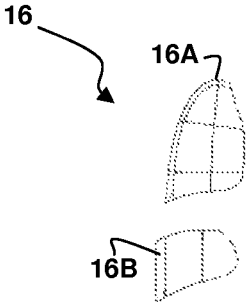
Figure 14:
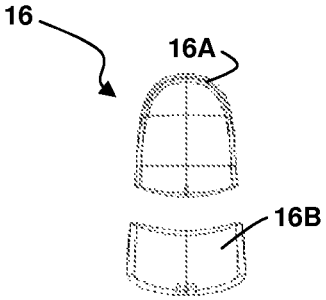
Figure 14B:
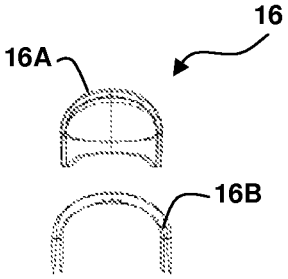
Figure 15A:
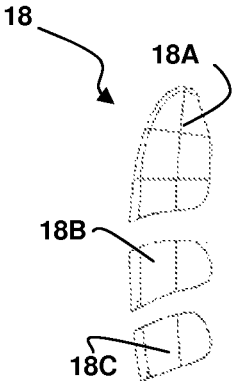
Figure 15:
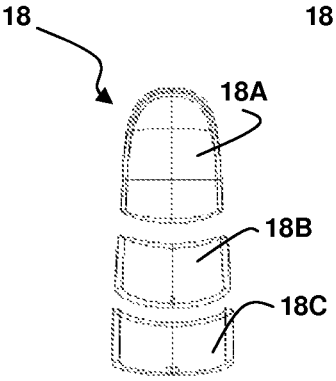
Figure 15B:
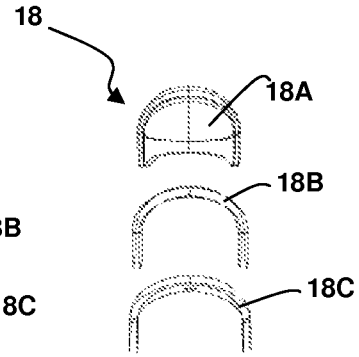
Figures 16, 16A, 17, 17A, 18, 18A, 18B, 19, 19A, 19B, 19C, 20, 21, 22:
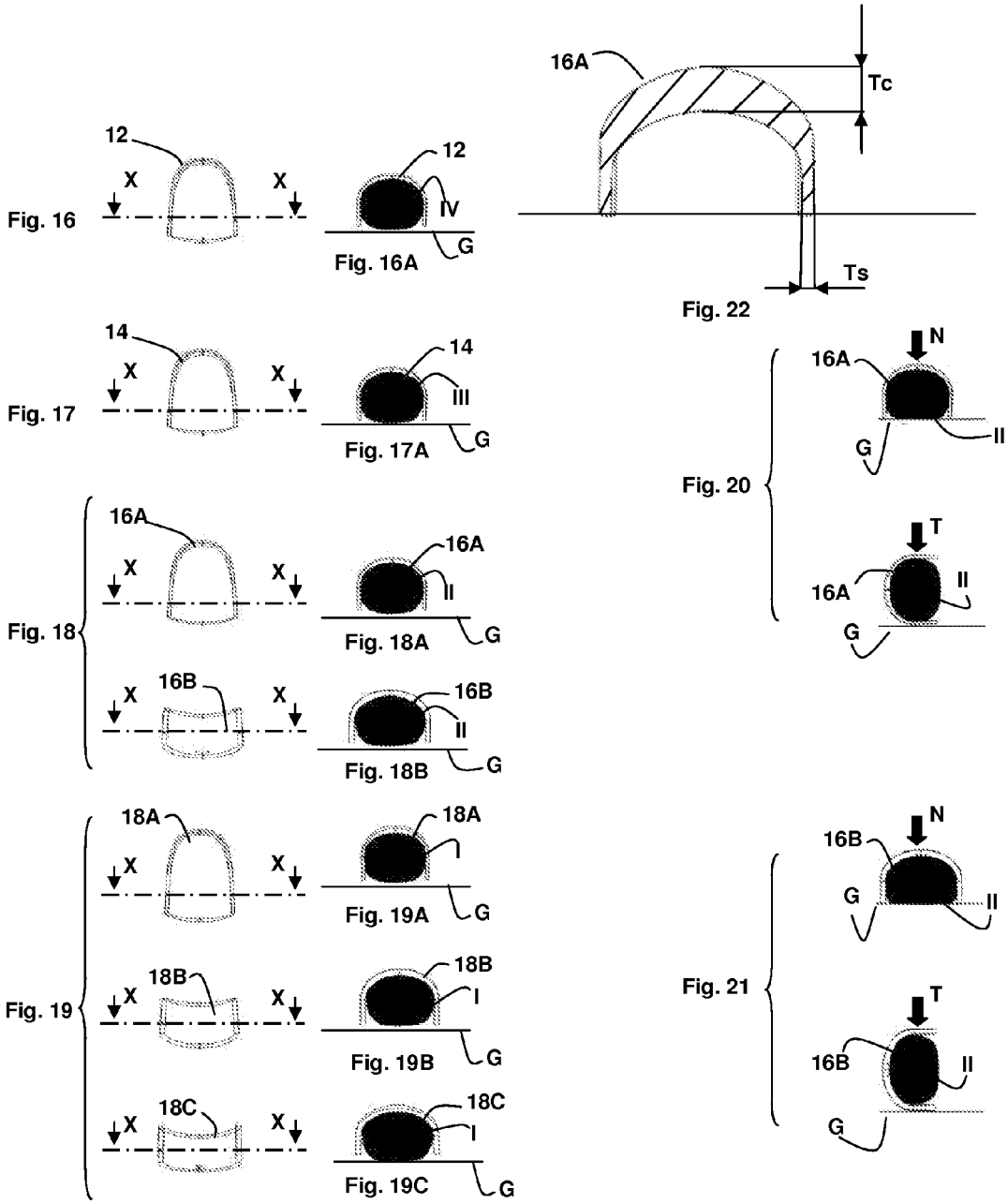
Figure 23:
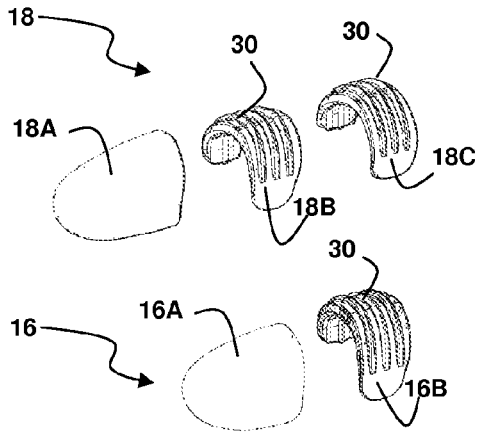
Figure 24:
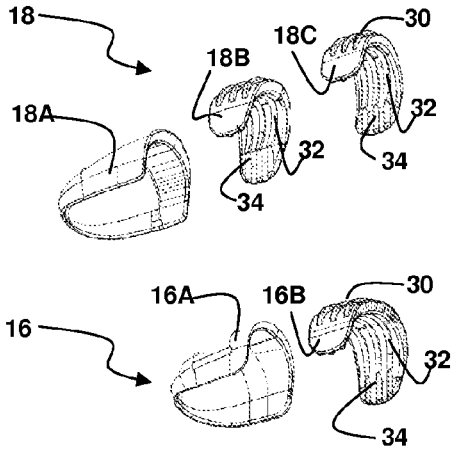
Figure 25:
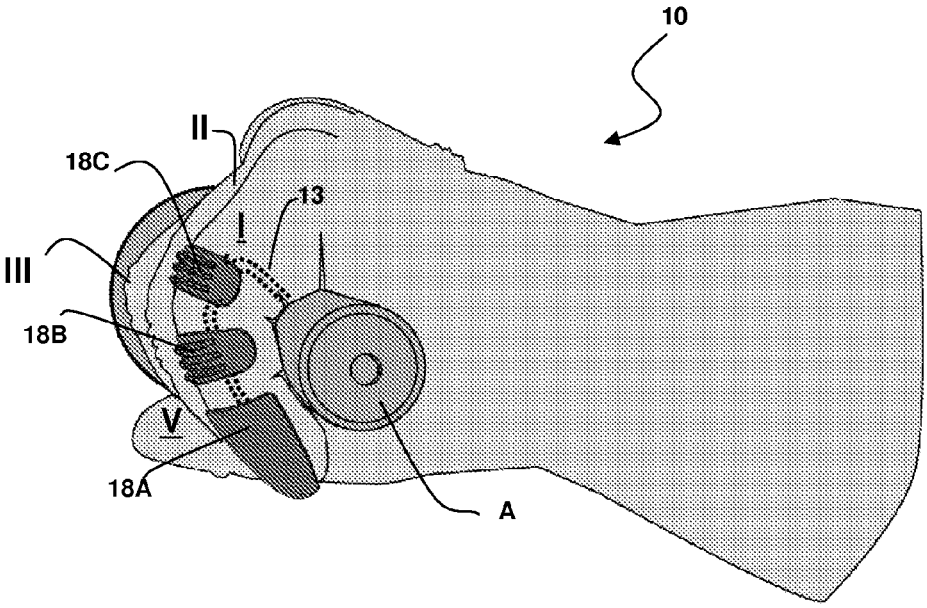

FIG. 3 schematically shows a side view of a protective element suitable for being applied on the glove structure according to the invention;

FIGS. 4, 5, 6 and 7 respectively show a perspective view, a first side view, a second side view and a bottom view of an element of the glove structure according to the invention in an intermediate manufacturing step of the glove structure;

FIGS. 8, 8A, 9, 9A, 10, 10A, 11 and 11A show perspective views of protective elements suitable for being applied on the glove structure according to the invention;

FIGS. 12, 12A and 12B schematically show a bottom view, a side view and a rear view of a first protective element suitable for being applied on the glove structure according to the invention;

FIGS. 13, 13A and 13B schematically show a bottom view, a side view and a rear view of a second protective element suitable for being applied on the glove structure according to the invention;

FIGS. 14, 14A and 14B schematically show a bottom view, a side view and a rear view of a third protective element suitable for being applied on the glove structure according to the invention;

FIGS. 15, 15A and 15B schematically show a bottom view, a side view and a rear view of a fourth protective element suitable for being applied on the glove structure according to the invention;

FIGS. 16, 17, 18 and 19 are simplified views of FIGS. 12, 13, 14 and 15, respectively;

FIGS. 16A, 17A, 18A, 18B, 19A, 19B and 19C show a simplified cross sectional view of the protective elements of FIGS. 16, 17, 18 and 19 according to the planes X-X;

FIGS. 20 and 21 are variants of FIGS. 18A and 18B showing how a protective element of the glove structure according to the invention protects the finger against normal and tangential compression forces;

FIG. 22 is a simplified enlarged view of FIG. 18A;

FIG. 23 shows perspective views of a second embodiment of the protective elements of FIGS. 8 and 9;

FIG. 24 is a view similar to FIG. 23, but taken from a different perspective;

FIG. 25 is a view similar to FIG. 2 but showing a second embodiment of the glove structure of the present invention.

In the following description, as "palmar portion" of the glove structure there will be indicated the portion of the glove structure that, when the hand wearing the glove structure is in open configuration, is relatively closer to the palm of the hand of the wearer. Similarly, as "dorsal portion" of the glove structure there will be indicated the portion of the glove structure that, when the hand wearing the glove structure is in open configuration, is relatively closer to the back of the hand of the wearer.

As "side portion" of the glove structure there will be indicated the portion of the glove structure connecting the dorsal and palmar portion.

As "inner surface" of the components of the glove structure there will be indicated the surface of the components of the glove structure which during normal use is near the hand (dorsal or palmar portion), while as "outer surface" of the components of the glove structure there will be indicated the surface of said components opposite to the inner surface.

With reference to the attached figures, an example of a glove structure according to the invention is indicated in its whole by the reference 10.

The glove structure 10 comprises a glove 11 which is shaped according to the profile of the fingers and of the hand of the user wearing the glove structure 10.

Said glove 11 comprises a dorsal portion 11A and a palmar portion 11B. The glove 11 is preferably made of leather or other similar material or fabric.

Figure 1A:
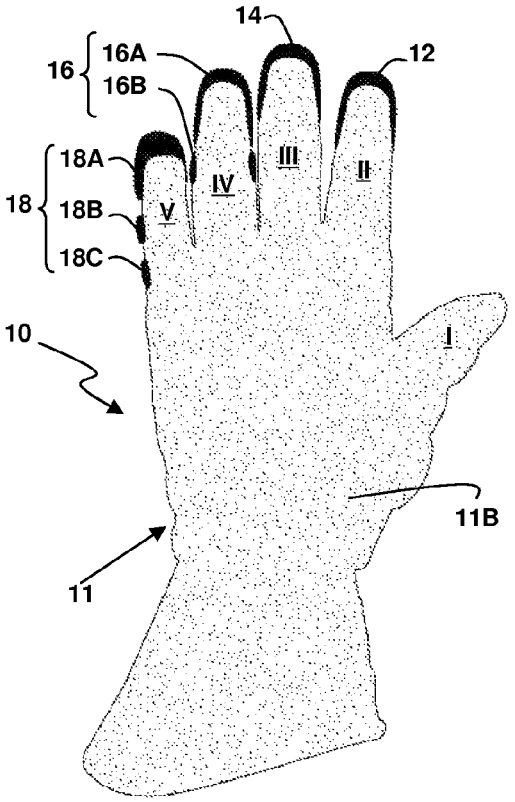
FIG. 1A shows a bottom or palm view of the glove structure according to the invention.
Figure 1:
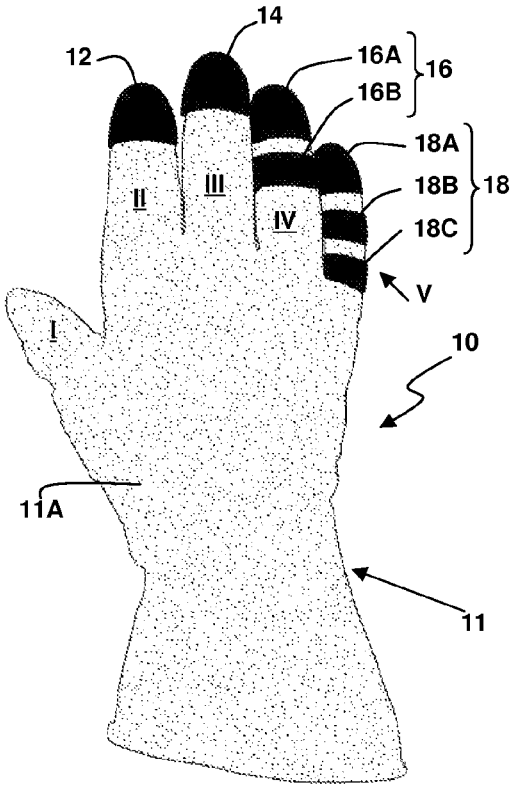
FIG. 1 shows a top or back view of the glove structure according to the invention.

According to FIGS. 1 and 1A, the glove 11 comprises respectively a thumb portion I, an index portion II, a medium portion III, a ring portion IV and a little finger portion V. Said finger portions I, II, III, IV, V of the glove 11 are suitable for housing the thumb, the index, the medium, the ring and the little finger of the hand of the user.

Preferably, each finger portion I, II, III, IV, V of the glove 11 comprises a dorsal portion and a palmar portion which are joined to each other by means of stitching 13 (see FIGS. 2 and 4-7).

Three different phalanx areas can be defined in the finger portions II, III, IV, V of the glove 11: a distal phalanx area, an intermediate phalanx area and a proximal phalanx area. Approximately, the distal phalanx area of said finger portions, when the glove 11 is worn by the user, encompasses the distal phalanx of the finger, while the intermediate and the proximal area encompass respectively the intermediate phalanx and the proximal phalanx of the finger of the user.

Only a distal phalanx area and a proximal phalanx area can be defined in the thumb portion I of the glove, since the thumb does not have an intermediate phalanx. Said phalanx areas respectively encompass the distal and the proximal phalanx of the thumb.

The glove structure 10 further comprises at least one protective element 12, 14, 16, 16A, 16B, 18, 18A, 18B, 18C suitable for being applied on the dorsal portion 11A of at least one phalanx area of the glove 11. Said protective element 12, 14, 16, 16A, 16B, 18, 18A, 18B, 18C is made of rigid material and is shaped so as to cover the dorsal portion 11A and the side portions 11C and to leave uncovered the palmar portion 11B of the phalanx area of the glove 11 on which is applied.

According to the invention, said protective element 12, 14, 16, 16A, 16B, 18, 18A, 18B, 18C is adapted to transmit along a path surrounding the phalanx area on which is applied compression forces acting on said phalanx area. This transmission of the compression forces around the phalanx can be better understood by the skilled person by making reference to FIGS. 20 and 21.

The glove structure 10 shown in the attached figures is a simplified view of a motorcycle glove. However, a glove structure 10 according to the invention can be advantageously used in all fields where an effective protection of the fingers, together with an improved tactile sensibility of the hand wearing the glove structure, must be obtained.

According to the exemplifying embodiment of the glove structure shown in FIGS. 1 and 1A, the protective elements 12, 14, 16, 16A, 16B, 18, 18A, 18B, 18C are preferably applied on the dorsal portion 11A of the index finger portion II, of the medium finger portion III, of the ring finger portion IV and of the little finger portion V. However, a protective element can also be provided on the thumb finger portion I.

According to a first embodiment of the invention, the protective element 18, which is applied on the little finger portion V of the glove 11, is preferably composed by three different components 18A, 18B and 18C.

The first component 18A is suitable for being applied on the distal phalanx area, while the second component 18B and the third component 18C are suitable for being respectively applied on the intermediate and on the proximal phalanx area of the little finger portion V.

In a similar way, according to the embodiment shown in FIGS. 1 and 1A, the protective element 16, which is applied on the ring finger portion IV of the glove 11, is preferably composed by two components 16A and 16B.

The first element 16A is suitable for being applied on the distal phalanx area, while the second element 16B is adapted for being applied on the intermediate phalanx area of the ring finger portion IV.

According to the embodiment shown in FIGS. 1 and 1A, the protective elements 14 and 12, which are suitable for being applied respectively on the medium III and on the index portion II of the glove 11, comprise one component only.

Such elements 12, 14 are preferably applied on the glove 11 at the distal phalanx area of the corresponding finger portion II, III.

The provision of more than one component on the little finger and on the ring finger is justified by the fact that such fingers, being the smallest and outermost fingers of the hand, are particularly vulnerable to injuries. Moreover, the little finger and the ring finger, due to their position close to the ulnar portion of the hand, are more exposed than the other fingers to abrasion and compression injuries. As ulnar portion of the hand, according to the terminology commonly used in anatomy, it is to be intended the portion of the hand close to the ulnar bone.

Different arrangements of the protective elements on the glove structure are possible, in order to meet other specific needs.

As it is shown in the attached figures, each protective element 12, 14, 16, 16A, 16B, 18, 18A, 18B, 18C is shaped such as to be not superimposed, once the glove structure 10 is worn by the user, to the joints articulations between the phalanges of the finger of the hand. In this way, the movements of the hand of the wearer are not hindered by the protective elements of the glove structure 10. As a matter of fact, the wearer is able to freely bend his fingers.

According to the exemplifying embodiments shown in FIGS. 8, 8A, 9, 9A, 10, 10A, 11 and 11A, each of said protective elements 12, 14, 16A, 16B, 18A, 18B and 18C has a cross section having preferably an open ring shape and it is designed to closely fit the phalanx area on which is applied.

Preferably, each protective element 12, 14, 16A, 16B, 18A, 18B and 18C has a cross section having a "C" or "U" shape (see the FIGS. 12, 12A, 12B, 13, 13A, 13B, 14, 14A, 14B, 15, 15A and 15B). The C-shaped profile comprises two leg sections which are interconnected to each other by means of a connecting surface. The protective element is applied to the finger portion of the glove with the connecting surface in strictly contact with the dorsal portion of the corresponding phalanx area. The leg sections of each protective element, when the latter is applied on the glove, are disposed on the side surfaces 11C of the corresponding phalanx area (see FIGS. 5-6).

Advantageously, the protective elements 12, 14, 16A and 18A which are suitable for being applied at the distal phalanx areas of the finger portions of the glove 11 can be shaped so as to protect the tips of the fingers (see FIGS. 8, 8A, 9, 9A, 10, 10A, 11 and 11A). In this case, the "C" or "U" shaped profile of said protective elements has a rounded end suitable for matching the tips of the fingers.

As it is shown in detail in FIG. 1A, each protective element 12, 14, 16A, 16B, 18A, 18B and 18C is applied on the glove 11 having the open side of the open ring or C shaped cross section faced towards the palmar portion of each finger portion II, III, IV and V.

In detail, the terminal ends of the leg sections of the C or U shaped cross section of each protective element, once the protective element has been applied on the finger portion of glove 11, have a sufficient length to be substantially aligned with the palmar portion of each finger portion II, III, IV and V (see FIGS. 16, 16A, 17, 17A, 18, 18A, 18B, 19, 19A, 19B and 19C).

In this way, when the hand wearing the glove structure 10 is positioned in its open configuration on a flat surface G, the gap between the terminal ends of the two leg sections of each protective element allows the wearer to feel the surface G that he is touching, not being hindered by the protective elements provided on the glove 11. As a matter of fact, the palmar portion of the fingers can contact the operation surface G (see FIGS. 16A-17A-18A-18B-19A-19B-19C).

At the same time, also when the hand wearing the glove structure 10 is gripping a round object, as for example the handlebar of a motorcycle, the gap between the terminal ends of the two leg sections of each protective element allows the wearer to feel the surface that he is touching. As a matter of fact, even if the operation surface is curved, the palmar portion of the fingers can contact the operation surface (see for example FIG. 2 and FIG. 25).

Each protective element 12, 14, 16, 16A, 16B, 18, 18A, 18B, 18C has a different size such that it can follow closely the profile of the finger portion II, III, IV and V on which is applied, without generating any pressure on the fingers of the wearer.

Moreover, the components of the protective elements 12, 14, 16, 18, which are composed by more than one component (such as, for example, those on the little finger or on the ring finger of FIGS. 1, 1A and 2), are properly spaced from adjacent components along the dorsal portion of the corresponding finger portion.

As it has been anticipated, each protective component is applied to the glove 11 such as to be not superimposed, when the glove structure 10 is in use, to the joint articulations of the phalanges of the fingers of the wearer. In this way, not only the movements of the hand of the wearer are not hindered by the protective elements, but also there is no risk that adjacent protective elements can be getting in touch to each other during the bending of the hand. In particular, and this is one of the advantages offered by the present invention, when the hand of the wearer attempts to grip a round object, as for example the handlebar of a motorcycle, there is no interference between the C or open ring shaped protective elements of the glove structure (see FIG. 2 and FIG. 25). As a consequence, also the movements of the fingers of the user's hand for handling rounded object are not hindered by the protective elements 12, 14, 16, 18.

As above mentioned, the protective elements 12, 14, 16, 18 are made of rigid material. Preferably, said protective elements are manufactured from a fibre reinforced polymer. An example of said kind of material is a carbon-fibre reinforced polymer, wherein the polymer can be epoxy, polyester, nylon or the like. The reinforcing carbon fibres of the polymeric matrix may be in form of either continuous or discontinuous fibres. The orientation of the carbon fibres, following the C shaped cross section of the protective elements, provides a high rigidity to the protective elements.

Such composite materials have high modulus of elasticity and high strength. Moreover, such composite materials allow obtaining lightweight protective elements. Furthermore, the protective elements made by composite material are resistant to the abrasion and are able to withstand axial and lateral impact loads. For what it concerns the present invention, an axial load will be a force directed along a direction substantially perpendicular to the back portion of the hand, while a lateral load will be a force directed along a direction running substantially from the thumb to the little finger (or vice versa) parallel to the back and to the palm portion of the hand.

In FIGS. 20 and 21, there is schematically shown the case in which an axial load N is applied to the dorsal portion of the ring finger portion IV of the glove structure 10.

It is supposed that said axial load N presses the glove structure against an opposing surface G. In this case, due to the specific shape of the protective elements, the terminal ends of the protective element 16A, 16B will contact said opposing surface G before that the phalanges of the wearer's hand can be crushed against the opposing surface G. Therefore, the protective elements permit that any force applied on the finger portions II, III, IV and V of the glove structure 10 can be transmitted along a path which surrounds the phalanges of the user's hand, preserving them from serious injuries.

The protective elements of the present invention are also effective if a lateral load T is applied on the glove structure 10.

In FIGS. 20 and 21 it is also schematically shown the case in which a lateral load T is applied to the side portion of the ring finger portion IV of the glove structure 10.

It is supposed that said lateral load T presses the glove structure against an opposing surface G. Also in this case, the specific shape of the protective elements 16A, 16B allows the lateral load T to be transmitted along a path surrounding the phalanges of the user's hand, avoiding that said phalanges can be crushed over the opposing surface.

As a matter of fact, the high rigidity of each protective element prevents the leg sections of the protective element from collapsing while compressed.

Preferably the thickness of the C shaped cross section of each protective element is not regular. As a matter of fact, each protective element has a C shaped cross section having a tapered thickness. Preferably, the thickness Tc of the connecting surface is greater than the thickness Ts of the leg side portions allowing the connecting surface of each protective element to provide the majority of the strength required to absorb lateral load T (see FIG. 22). Preferably, the thickness Tc is about 2.0 mm.

Moreover, the glove structure 10 according to the invention is also suitable for protecting the palmar portion of the finger portions I, II III, IV, V, even if such palmar portion is kept free from specific protections. As a matter of fact an object which would hit the palmar portion of the finger portions of the glove structure, contacted the terminal ends of the leg portions of the protective element, before crushing the phalanges of the wearer. For example, in view of the above notes, the glove structure offers an improved protection against compression injuries when, following to a fall, the hand of the rider is trapped, with the dorsal portion sliding along the road surface, between the road surface and the motorcycle.

Therefore a glove structure 10 according to the invention permits a full protection of the fingers against crushing forces N, T.

A second embodiment of the protective elements of the glove structure according to the invention is shown in FIGS. 23 and 24.

In this embodiment the connecting surface of the protective elements 16B, 18B, 18C is provided on its outer surface with reinforcing ribs 30. Preferably, said reinforcing ribs are in number of three.

Additionally, as it is shown in FIG. 24, the connecting surface of the protective elements 16B, 18B, 18C is provided on its inner surface with lightening grooves 32. Said lightening grooves 32 may be interposed between adjacent reinforcing ribs 30 and protruding towards the inner surface of the connecting surface of the protective elements 16B, 18B, 18C.

Moreover, as it is shown in FIG. 24, also the leg sides of the protective elements 16B, 18B, 18C may be provided on their inner surface with additional reinforcing ribs 34. Preferably, said reinforcing ribs 34 have rounded edges so as to not hurt the user in case the phalanx area of the corresponding finger portions get in contact with the inner surface of the leg sides of the protective elements.

Even if in FIGS. 23 and 24 only the protective elements 16, 18 are shown, namely the protective elements applied on the ring finger portion IV and on the little finger portion V of the glove 11, advantageously the reinforcing ribs 30, 34 and the lightening grooves 32 may also be applied on the protective elements 12, 14 suitable for being applied on the medium III and on the index portion II of the glove 11, respectively.

Advantageously, the reinforcing ribs 30 and 34 are suitable for reinforcing the structure of the protective elements 12, 14, 16, 18 of the glove structure 10, without hindering the user or reducing the gripping action of the fingers on the motorcycle's controls (see FIG. 25). In detail, said ribs 30, 34 further contribute in dispersing the axial load N applied on the dorsal portion of the glove structure and the lateral load T applied on the side portion of the glove.

The lightening ribs 34 have the function to lighten the structure of the protective element without weakening thereof.

However, the high rigidity of the protective elements of the glove structure 10 does not allow to apply such protective elements to the glove in a conventional way by means of stitching. As a matter of fact, the needle of the sewing machine would not be able to penetrate the structure of the protective elements.

Therefore, a new and innovative method for manufacturing the glove structure of the present invention has been conceived. Such new method envisages the use of microfiber material patches which are suitable for allowing the bonding of the protective elements to the glove.

The method according to the invention comprises the following steps:

a) providing a patch 21A, 21B, 21C made of microfiber material on a phalanx area of a finger portion I, II, III, IV, V of the glove 11 in the corresponding location on the glove 11 where a protective element 12, 14, 16, 16A, 16B, 18, 18A, 18C will be applied;

b) applying a polymeric glue layer on the inner surface of a protective element 12, 14, 16, 16A, 16B, 18, 18A, 18B, 18C and on the outer surface of the patch 21A, 21B, 21C;

c) pressing the protective element 12, 14, 16, 16A, 16B, 18, 18A, 18B, 18C on the patch 21A, 21B, 21C so as to match the inner surface of the protective element 12, 14, 16, 16A, 16B, 18, 18A, 18B, 18C with the outer surface of the patch 21A, 21B, 21C in order to firmly joint the protective element 12, 14, 16, 16A, 16B, 18, 18A, 18B, 18C to the glove.

As it is well known, as "microfiber material" must to be intended a material made from ultra-fine manufactured fibres. Preferably, the patches 21A, 21B, 21C are pieces of microfiber material made from polyesters or polyamides or made from a combination of polyesters and polyamides.

The function of the patches 21A, 21B, 21C is to act as a support for the protective elements 12, 14, 16, 18 of the glove structure 10. The patches are built out of high density microfibres, strongly linked together. Such firm linkage between the fibres advantageously assures that, even in presence of high mechanical forces applied to the protective elements, the patches do not undergo delamination. In this way it is assured that the protective elements 12, 14, 16, 18 cannot be separated from the glove, assuring a high level of protection to the fingers of the user.

Preferably, the patches 21A, 21B, 21C have a thickness of about 0.5-1.3 mm, preferably about 0.7-1.1 mm.

The patches are specifically shaped according to the shape of the protective elements to which must be bonded. The position and the number of the patches to be applied on the glove correspond to the position and to the number of the protective elements of the glove structure.

Preferably, the patches 21A, 21B, 21C are applied on the phalanx areas of the finger portions I, II, III, IV, V of the glove 11 by means of stitching 22 (see FIGS. 4-7).

Advantageously, the porous structure of said patches allows the polymeric glue to deeply penetrate inside them, assuring in this way a good adhesion between the patches, which are firmly fixed to the glove, and the protective elements.

Preferably, the patches are provided on the glove 11 during the manufacturing process of the finger portions I, II, III, IV, V.

Before applying the polymeric glue layer on the inner surface of the protective elements 12, 14, 16, 16A, 16B, 18, 18A, 18B, 18C and on the outer surface of the patches 21A, 21B, 21C, the inner surface of the protective elements 12, 14, 16, 16A, 16B, 18, 18A, 18B, 18C and the outer surface of the patches 21A, 21B, 21C can be pre-treated with a primer activator. In this way, the adhesion between the protective elements 12, 14, 16, 16A, 16B, 18, 18A, 18B, 18C and the glove 11 is improved.

After having applied the polymeric glue on the inner surface of protective element and on the outer surface of the corresponding patch, said elements are left to rest for about 10 minutes.

In this way the polymeric glue, preferably a polyurethane based glue, may penetrate in depth the fibres of the patches. Moreover, such rest time allows to complete the drying of the glue.

Successively, before pressing the protective element 12, 14, 16, 16A, 16B, 18, 18A, 18B, 18C onto the corresponding patch 21A, 21B, 21C, the polymeric glue layer applied on the inner surface of the protective element and on the outer surface of the patch can be heat reactivated at a temperature greater than 200° C. for about 30 seconds.

Preferably the temperature at which the protective elements and the patches are reactivated is about 300° C.

Alternatively, the polymeric glue layer applied on the inner surface of the protective element and on the outer surface of the patch can be heat reactivated at a temperature of about 500° C. for about 10 seconds.

The method according to the invention has the advantage to not reduce the flexibility of the glove 11 to which the protective elements are applied. At the same time, the provision of intermediate patches made of microfiber material between the glove and the protective elements allows to obtain, even if the protective elements are rigid, a firm connection between them and the glove.

As a matter of fact, the polymeric glue, thanks to the porous structure of the patches, penetrates in depth inside them offering a great anchoring surface to the protective elements applied above them. After having pressed the protective elements over the patches, said two elements are so firmly connected to each other that they can be considered as one solid element. The patches 21A, 21B, 21C and the protective elements 12, 14, 16, 18 are preferably bonded together by applying high pressure, so as to create a "one-piece structure" between patches and protective elements.

Therefore, being the patches fixed to the glove by means of stitching, the connection between the protective elements and the glove has the same resistance which would have been obtained by stitching the protective elements to the glove, if this was possible. Furthermore, as a result of the new and innovative method used to apply the protective elements to the glove, a greater portion of the stitching lines 13, joining to each other the palmar and dorsal portion of the finger portions I, II, III, IV, V, is covered by the protective elements of the glove structure (see FIG. 2).

In this way, the glove structure also offers a greater protection against injuries due to abrasion. As a matter of fact, being the stitching lines protected, it is reduced the risk that the glove could tear along the stitching lines 13 of its finger portions in case of a sliding over the road surface.

Advantageously, also the portion of the stitching lines 13 which is not directly covered by the protective element, thanks to the thickness of the protective element which in case of a fall will be interposed between the ground and the glove, will be protected against tearings.

Furthermore, the protective elements are applied over the patches so as to completely cover the stitching 22 by means of which the patches are fixed to the glove. Such occurrence can be easily imagined by a skilled man in the art by superimposing, for example, the protective element shown in FIG. 3 to the finger portion depicted in FIG. 5.

In this way, in case of a fall, the stitching 22 is protected by the protective element against abrasion and there is no risk that the protective element can be detached from the glove.

From the above description it is clear that the glove structure according to the present invention has characteristics suitable to advantageously solve the problems and drawbacks set out in the prior art. In particular, the glove structure according to the present invention, is suitable for not diminishing the sensitivity of feel experienced by the rider on the bottom surface of the fingers, providing at the same time an improved level of protection over existing products.

The present invention has been described with reference to a preferred embodiment, but mechanically equivalent solutions are foreseeable falling within the scope of the following claims.

The invention claimed is:

1. A glove structure comprising a glove and at least one protective element suitable for being applied on a dorsal portion of at least one phalanx area of at least one finger portion of the glove, said at least one protective element being made of rigid material and being shaped so as to cover the dorsal portion and side portions of the at least one phalanx area and to leave uncovered a palmar portion of said at least one phalanx area, said at least one protective element being adapted to transmit along a path surrounding said at least one phalanx area compression forces acting on said at least one phalanx area;

wherein the glove structure comprises at least one patch made of microfiber material, said at least one patch being fixed on the at least one phalanx area of the at least one finger portion of the glove; and wherein said at least one protective element is applied to the glove so as to be matched with said at least one patch.

2. The glove structure according to claim 1, wherein said at least one protective element has a cross section having a shape of an open ring.

3. The glove structure according to claim 2, wherein said at least one protective element has a cross section having a shape of a C or U.

4. The glove structure according to claim 1, wherein said at least one protective element is made from a fiber reinforced polymer.

5. The glove structure according to claim 3, wherein the C or U shaped cross section of said at least one protective element comprises two leg sections which are interconnected by means of a connecting surface, and wherein terminal ends of said two leg sections are substantially aligned once said at least one protective element is applied to the glove, with the palmar portion of the at least one finger portion to which said at least one protective element is fixed.

6. The glove structure according to claim 5, wherein the C or U shaped cross section of said at least one protective element has a tapered thickness, wherein thickness of the connecting surface is greater than thickness of the two leg sections.

7. The glove structure according to claim 1, wherein said at least one protective element is applied to the at least one finger portion of the glove so as to be not superimposed, when the glove structure is in use, to joint articulations of phalanges of fingers of a wearer.

8. The glove structure according to claim 1, wherein the dorsal portion and the palmar portion of each finger portion of the glove are joined to each other by means of stitching; said at least one protective element, once applied on the glove, being suitable for covering at least partially said stitching.

9. The glove structure according to claim 1, wherein said at least one patch is a piece of microfiber material made from polyesters or polyamides or made from a combination of polyesters and polyamides.

10. The glove structure according to claim 1, wherein said at least one patch has a thickness in the range between 0.5 mm and 1.3 mm.

11. The glove structure according to claim 5, wherein the connecting surface of said at least one protective element is provided on an outer surface of said glove with reinforcing ribs.

12. The glove structure according to claim 5, wherein the connecting surface of said at least one protective element is provided on an inner surface of said glove with lightening grooves.

13. The glove structure according to claim 5, wherein each leg section of the protective elements is provided on an inner surface of said glove with additional reinforcing ribs.

14. Method for manufacturing the glove structure according to claim 1, the method comprising the steps of:

providing the at least one patch made of microfiber material on the at least one phalanx area of at least one finger portion of the glove in a corresponding location on the glove where the at least one protective element is to be applied;

applying a polymeric glue layer on an inner surface of the at least one protective element and on an outer surface of said at least one patch;

pressing the at least one protective element on the at least one patch so as to match the inner surface of the at least one protective element with the outer surface of said at least one patch in order to firmly join the at least one protective element to the glove.

15. The method according to claim 14, wherein the at least one patch, provided on the glove, is applied on said at least one phalanx area of said at least one finger portion of the glove by means of stitching.

16. The method according to claim 14, wherein before applying the polymeric glue layer on the inner surface of said at least one protective element and on the outer surface of said at least one patch, the inner surface of said at least one protective element and the outer surface of said at least one patch are pre-treated with a primer activator for improving adhesion between said at least one protective element and the glove.

17. The method according to claim 14, wherein before pressing said at least one protective element on the at least one patch, the polymeric glue layer applied on the inner surface of said at least one protective element and on the outer surface of said at least one patch is heat reactivated at a temperature greater than 200° C. for 30 seconds.

18. The glove structure according to claim 10, wherein said at least one patch has a thickness in the range between 0.7 mm and 1.1 mm.

19. The glove structure according to claim 1, wherein said at least one protective element is applied to the glove so as to overlay and align with said at least one patch.

20. A glove structure comprising a glove and at least one protective element suitable for being applied on a dorsal portion of at least one phalanx area of at least one finger portion of the glove, said at least one protective element being made of rigid material and being shaped so as to cover the dorsal portion and side portions of the at least one phalanx area and to leave uncovered a palmar portion of said at least one phalanx area, said at least one protective element being adapted to transmit along a path surrounding said at least one phalanx area compression forces acting on said at least one phalanx area;

wherein the glove structure comprises at least one patch made of microfiber material, said at least one patch being fixed on the at least one phalanx area of the at least one finger portion of the glove; and wherein said at least one protective element is applied to the glove so as to be correspondingly matched with said at least one patch, said at least one patch having same shape and size as the at least protective element.

21. A glove structure comprising a glove and at least one protective element suitable for being applied on a dorsal portion of at least one phalanx area of at least one finger portion of the glove, said at least one protective element being made of rigid material and being shaped so as to cover the dorsal portion and side portions of the at least one phalanx area and to leave uncovered a palmar portion of said at least one phalanx area, said at least one protective element being adapted to transmit along a path surrounding said at least one phalanx area compression forces acting on said at least one phalanx area;

wherein the glove structure comprises at least one patch made of microfiber material, said at least one patch being fixed by means of a stitching line on the at least one phalanx area of the at least one finger portion of the glove; and wherein said at least one protective element is applied to the glove so as to be matched with said at least one patch.

22. The glove structure according to claim 21, wherein the at least one protective element is matched with said at least one patch so as to completely cover the stitching line.

* * * * *